US009286875B1

(12) United States Patent
Kerr

(10) Patent No.: US 9,286,875 B1
(45) Date of Patent: Mar. 15, 2016

(54) ELECTRONIC PERCUSSION INSTRUMENT

(71) Applicant: Simply Sound, Atlanta, GA (US)

(72) Inventor: Steven D. Kerr, Atlanta, GA (US)

(73) Assignee: Simply Sound, Atlanta, GA (US)

( * ) Notice: Subject to any disclaimer, the term of this patent is extended or adjusted under 35 U.S.C. 154(b) by 170 days.

(21) Appl. No.: 13/913,675

(22) Filed: Jun. 10, 2013

(51) Int. Cl.

| | |
|---|---|
| ***G10H 1/00*** | (2006.01) |
| ***G10H 1/06*** | (2006.01) |
| ***G10H 1/18*** | (2006.01) |
| ***G10H 3/12*** | (2006.01) |
| ***G10H 3/26*** | (2006.01) |
| ***G10H 5/00*** | (2006.01) |
| ***G10D 13/00*** | (2006.01) |
| ***G10D 13/02*** | (2006.01) |
| ***A47C 7/72*** | (2006.01) |

(52) U.S. Cl.
CPC .. *G10H 3/26* (2013.01); *A47C 7/72* (2013.01); *G10D 13/00* (2013.01); *G10D 13/02* (2013.01); *G10H 1/00* (2013.01); *G10H 1/0008* (2013.01); *G10H 5/007* (2013.01)

(58) Field of Classification Search
CPC ..... G10H 1/00; G10H 1/0008; G10H 5/007; G10D 13/00; G10D 13/02; H04R 5/02
USPC ..... 84/622, 402, 600, 615, 645, 730
See application file for complete search history.

(56) References Cited

U.S. PATENT DOCUMENTS

| | | | | | |
|---|---|---|---|---|---|
| 223,394 | A * | 1/1880 | Schrenkeisen | A47C 9/08 | 297/186 |
| 4,753,146 | A * | 6/1988 | Seiler | G10H 1/348 | 84/730 |
| 5,373,096 | A * | 12/1994 | Suzuki | G10H 1/00 | 600/595 |
| 5,434,350 | A * | 7/1995 | Haney | G10H 1/32 | 84/730 |
| 5,437,453 | A * | 8/1995 | Hineman | A47C 15/004 | 434/29 |
| 5,512,703 | A * | 4/1996 | Usa | G10H 1/0558 | 84/600 |
| 5,841,052 | A * | 11/1998 | Stanton | G10H 1/32 | 84/107 |
| 5,856,628 | A * | 1/1999 | Noguchi | G10H 3/146 | 84/421 |
| 6,162,976 | A * | 12/2000 | Clausen | G10D 13/08 | 84/180 |
| 6,234,446 | B1 * | 5/2001 | Patterson | B64D 11/0015 | 224/201 |
| 6,342,665 | B1 * | 1/2002 | Okita | A63F 13/00 | 84/600 |
| 6,376,757 | B1 * | 4/2002 | Clausen | G10D 13/08 | 297/186 |
| 6,380,923 | B1 * | 4/2002 | Fukumoto | G06F 1/163 | 341/22 |
| 6,721,430 | B2 * | 4/2004 | Wang | H04R 5/023 | 381/301 |
| 6,734,349 | B1 * | 5/2004 | Adams | G10D 13/003 | 84/315 |
| 6,819,771 | B2 * | 11/2004 | Menzies | H04R 5/023 | 381/301 |
| 7,183,480 | B2 * | 2/2007 | Nishitani | G10H 1/00 | 84/609 |
| 7,520,567 | B2 * | 4/2009 | Billger | A47C 3/18 | 180/330 |
| 7,807,910 | B1 * | 10/2010 | Berardo | G10D 13/02 | 84/411 R |
| 7,842,879 | B1 * | 11/2010 | Carter | G10H 3/143 | 84/600 |

(Continued)

*Primary Examiner* — David Warren
*Assistant Examiner* — Christina Schreiber
(74) *Attorney, Agent, or Firm* — Womble Carlyle Sandridge & Rice LLP

(57) ABSTRACT

An electronic percussion instrument includes a chair having a seat, a first arm disposed on one side of the seat, and a second arm disposed on an opposite side of the seat. A set of piezoelectric triggers is arrayed along each of the first and second arms and the triggers are positioned to be struck by the thumbs of a percussionist while sitting on the seat of the chair. The triggers are connected to an electronic drum machine. Sequential striking of the triggers with the thumbs of a percussionist sitting in the chair causes corresponding percussion sounds to be played by the electronic drum machine. Additional triggers are disposed on the floor and can be struck with the feet of the percussionist to produce additional percussion sounds. Thus, drum rhythms can be played easily and naturally while sitting in the chair.

24 Claims, 6 Drawing Sheets

(56) References Cited

U.S. PATENT DOCUMENTS 8,362,350 B2 * 1/2013 Kockovic ..... G10H 1/34 84/743
8,618,400 B2 * 12/2013 Murphy ..... G10H 1/348 84/600
8,664,508 B2 * 3/2014 Tabata ..... G10H 1/0008 84/723
8,822,800 B1 * 9/2014 Richmond ..... G10D 13/06 84/402
2003/0110929 A1 * 6/2003 Riopelle ..... G10H 1/00 84/615
2004/0112204 A1 * 6/2004 Javelle ..... G10H 1/34 84/645
2008/0054561 A1 * 3/2008 Canterbury ..... G07F 17/32 273/148 B
2009/0126554 A1 * 5/2009 Xu ..... G10H 1/24 84/610
2011/0086747 A1 * 4/2011 Broderick ..... A63F 13/08 482/142
2011/0132181 A1 * 6/2011 Kockovic ..... G10H 1/34 84/723
2012/0132746 A1 * 5/2012 Sizelove ..... B64D 11/0015 244/118.6
2012/0223555 A1 * 9/2012 Brown, Jr. ..... A47C 7/72 297/217.4
2013/0118339 A1 * 5/2013 Lee ..... G10H 1/32 84/725

* cited by examiner

| TRIGGER | ASSIGNED SOUND |
|---|---|
| HT1 | Kick Drum |
| HT2 | Hi Hat |
| T3 L&R | Snare Drum |
| T4 L&R | Closed Hi Hat |
| T5 L&R | Open Hi Hat |
| T6 L&R | Hi Tom |
| T7 L&R | Low Tom |
| T8 L&R | Floor Tom |
| T9 L&R | Crash Cymbal |
| T10 L&R | Ride Cymbal Rim |
| T11 L&R | Ride Cymbal Hub |
| T12 L&R | Percussion 1 |

FIG. 7

ELECTRONIC PERCUSSION INSTRUMENT

TECHNICAL FIELD

This disclosure relates generally to percussion instruments and more specifically to electronic percussion instruments.

BACKGROUND

Electronic percussion instruments are available in many configurations. Some mimic traditional acoustic drum kits with electronic triggers corresponding to the various drums and cymbals of an acoustic kit. Striking a pad triggers a drum machine to play a percussion sound or sounds assigned to the pad. A percussionist plays these types of electronic percussion instruments with sticks the same way that an acoustic drum kit would be played. Other electronic percussion instruments have an array of triggers on a flat playing surface that, when struck with a drum stick or a player's hand, trigger corresponding electronic drum sounds to be played. There is a need for an electronic percussion instrument that is easy and natural to play, that does not demand the substantial skill required to play a traditional acoustic drum kit, and that is intuitive and fun. It is to the provision of such an electronic percussion instrument that the present disclosure is primarily directed.

SUMMARY

Briefly described, an electronic percussion instrument comprises a chair having a pair of arms on either side of a seat of the chair. A set of thumb triggers, preferably of the piezoelectric type, is arrayed along at least a portion of the arms of the chair. The instrument further comprises an electronic drum machine and a cable connecting each set of thumb triggers to the electronic drum machine. Striking one of the thumb triggers causes a corresponding percussion sound to be played by the electronic drum machine, which may be amplified and broadcast through loudspeakers. The instrument also may include heel triggers that rest on the floor in front of the chair and that also are connected to the drum machine to play corresponding percussion sounds when struck. To play the electronic percussion instrument, a percussionist sits in the chair with her heels resting on the heel triggers. The various thumb triggers on the arms of the chair are then struck with the percussionist's thumbs and the heel triggers are struck with the heels of the percussionist's feet, all causing the electronic drum machine to play percussion patterns similar to those that can be played on an acoustic drum kit. These and other features, aspects, and advantages of the electronic percussion instrument will become more apparent upon review of the detailed description set forth below when taken in conjunction with the accompanying drawing figures, which are briefly described as follows.

BRIEF DESCRIPTION OF THE DRAWINGS

FIG. 7 is an example of the many ways that percussion sounds may be assigned to the various triggers.

DETAILED DESCRIPTION

Figure 1:
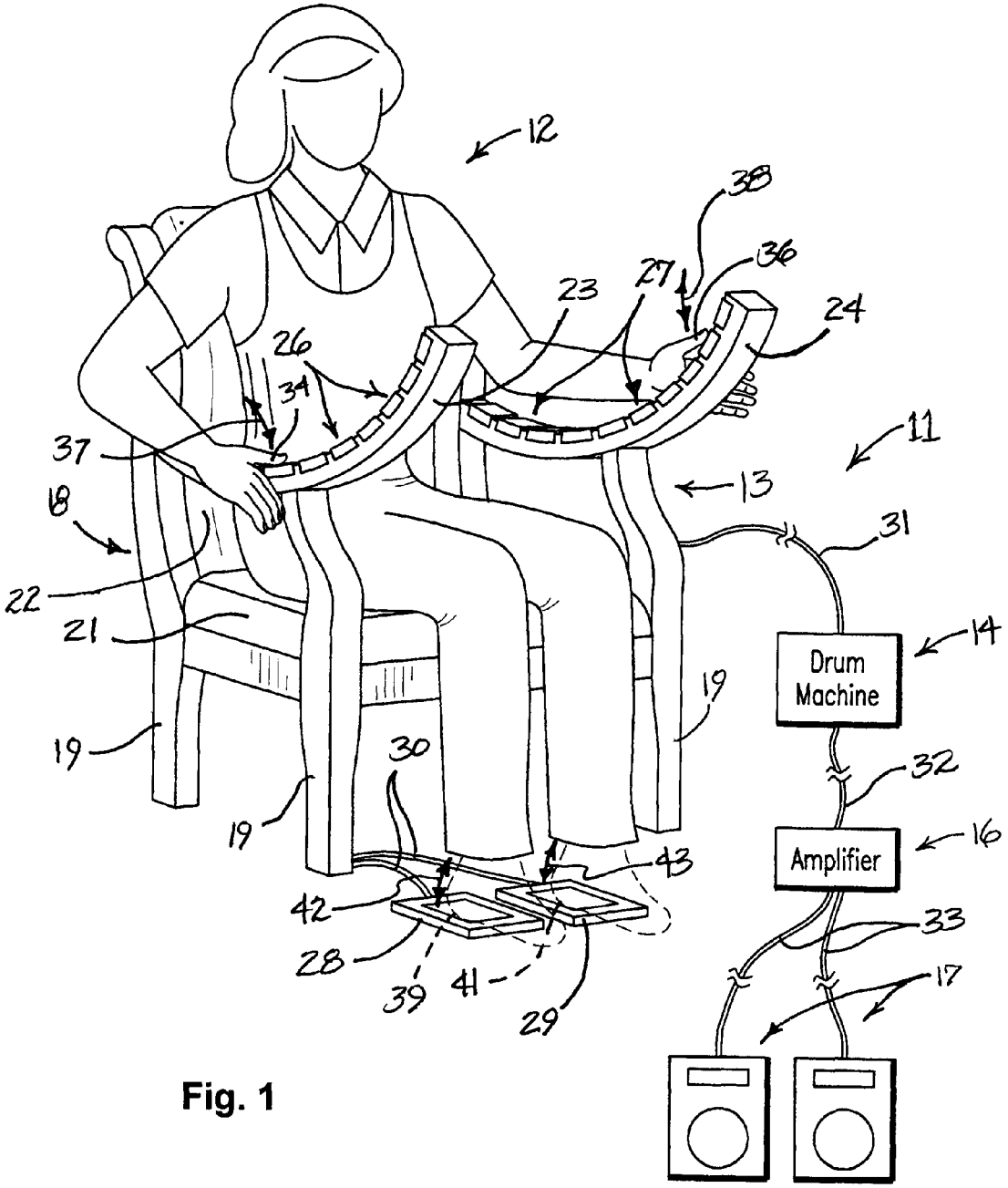
FIG. 1 is a perspective view illustrating an electronic percussion instrument that embodies principles of the invention in one form.

Referring now in more detail to the drawings, wherein like reference numerals indicate like parts throughout the several views, FIG. 1 shows the electronic percussion instrument 11 being played by a percussionist 12. The electronic percussion instrument 11 comprises a percussion controller 13 in the form of a chair 18; an electronic drum machine 14; an audio amplifier 16; and loudspeakers 17. The drum machine 14 is connected to the audio amplifier 16 via cable 32 and the audio amplifier 16 is connected to the loudspeakers 17 via cables 33. In the illustrated embodiment, the chair 18 has legs 19, a seat 21, and a back 22. A right arm 23 of the chair is situated on one side of the seat 21 to the percussionist's right and a left arm 24 is situated on the other side of the seat 21 to the percussionist's left. Each arm in this embodiment is upwardly curved in shape and extends from the back 22 of the chair forwardly and upwardly to a free end. A set of right side thumb triggers 26 is arrayed along the top side of the right arm 26 and a set of left side thumb triggers 27 is arrayed along the top side of the left arm 27. The thumb triggers 26 and 27 are connected to the drum machine 14 through cable 31 as described in more detail below.

The electronic percussion instrument further comprises a right heel trigger 28 and a left heel trigger 29 that are disposed on the floor just in front of the chair 18. The right heel trigger 28 can be positioned to underlie the right heel 39 of the percussionist 12 and the left heel trigger 29 can be positioned to underlie the left heel 41 of the percussionist 12. Wires 30 connect the heel triggers 28 and 29 to the instrument and ultimately, through cable 31, to the drum machine 14.

To play the electronic percussion instrument shown in FIG. 1, the percussionist 12 takes a seat in the chair 18 as illustrated. The arms 23 and 24 of the chair are contoured and positioned so that the right thumb 34 of the percussionist 12 can rest comfortably at any location along the length of the right arm 23 and the left thumb of the percussionist can rest comfortably at any location along the length of the left arm 24. In the illustrated embodiment, the top surface of the arms and the thumb triggers extend substantially horizontally at right angles to the sides of the arms. However, this is not a limitation and the top surfaces of the arms can be angled to the outside, to the inside, or their angle can gradually change from the back of the chair to the free ends of the arms. Any configuration of the arms that places the thumb triggers in a natural position and orientation for striking with the thumbs of a percussionist is contemplated by the present invention. The locations on the floor of the heel triggers 28 and 29 may be adjusted by the percussionist so that they rest comfortably beneath the heels of her feet as shown.

The percussionist 12 then can play the percussion instrument by taking a seat in the chair 18, striking the thumb triggers with her thumbs 34 and 36 as indicated by arrows 37 and 38. In addition, the heel triggers are struck when the percussionist raises her heels above the heel triggers and lowers them rapidly back to the pads as indicated by arrows 42 and 43. With each strike of a thumb trigger or a heel trigger, a signal is transmitted via cable 31 to the drum machine 14 causing the drum machine to play a percussion sound previously assigned to the struck trigger. In the illustrated embodiment, there are 10 thumb triggers arrayed along each arm of the chair in addition to the two heel triggers arranged on the floor. While this is not a limitation of the invention, it has been found that this number and arrangement of triggers allows the various percussion sounds of a typical acoustic drum kit to be represented and played on the electronic percussion instrument 11.

As discussed in more detail below, many if not all of the right thumb triggers 26 along the right arm 23 may be electrically connected with a corresponding left thumb trigger 27 on the left arm 24. Accordingly, the two thumb triggers of the pair produce the same percussion sound when struck. In this way, the percussionist can play, for instance, a snare drum or tom-tom cadence or riff with both thumbs without having to move one thumb from her left side to her right side or vice versa. Further, one of the heel triggers preferably is assigned the sound of a kick drum and the other preferably is assigned a hi-hat cymbal sound. This corresponds to the traditional use of the feet when playing an acoustic drum kit.

It has been found that percussion rhythms can be played with the thumbs and heels remarkably easily and naturally when playing the electronic percussion instrument described above. Inexperienced percussionists can play percussion rhythms after only a short time and experienced percussionists are able to play very complex percussion rhythms, bridges, cadences, and solos with ease. The experience is rather like following along with a favorite song by tapping ones thumbs on a desk. It comes naturally. Further, playing a traditional acoustic drum kit is physically intense and can be exhausting, especially if the player is not in top physical condition. Playing the electronic percussion instrument of the present invention requires far less physical exertion such that a percussionist can play for long periods of time without fatigue.

Figure 2:
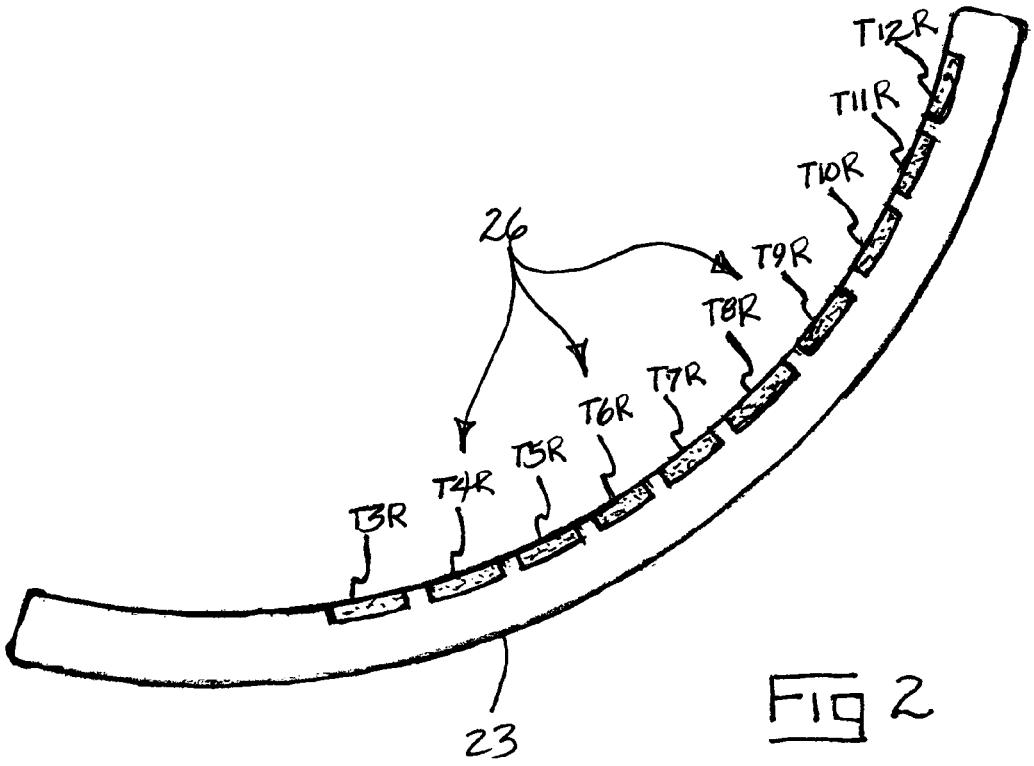
FIG. 2 is a side elevational view of one of the arms of the electronic percussion instrument of FIG. 1 showing one possible arrangement of thumb triggers therealong.

FIG. 2 illustrates the right arm 23 of the chair 18, with it being understood that the left arm preferably, but not necessarily, has the same configuration. The right arm 23 is curved from its back end to its free end in such a way that a percussionist's thumbs comfortably and naturally follow the curve of the arm as she raises and lowers her arms during play. A plurality of spaced thumb triggers 26 are arrayed along the top surface of the arm 23 and are located to be struck selectively by a percussionist's thumb during play. In the illustrated embodiment, ten (10) thumb triggers designated T3R through T12R are arrayed along the top surface of the right arm 23, but fewer or more thumb triggers may be used if desired. As mentioned, when one of the thumb triggers is struck with the thumb of the percussionist, a corresponding percussion sound such as, for instance, a drum sound, a cymbal sound, or some other sound previously assigned to the trigger is played by the drum machine 14 and sounded through the loudspeakers 17.

Figure 3:
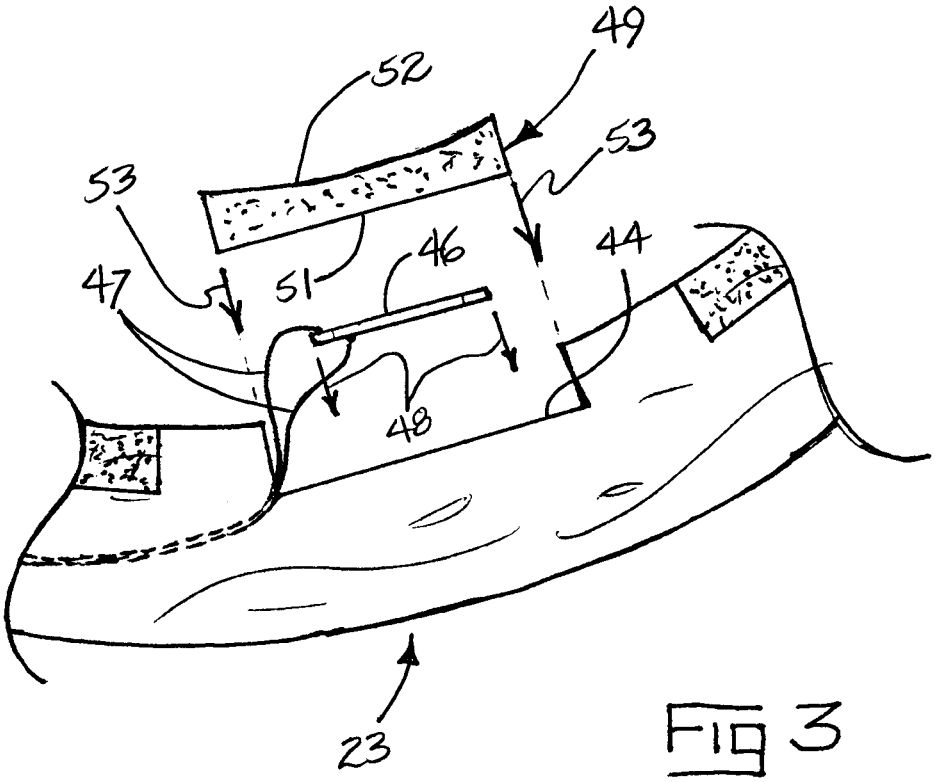
FIG. 3 is an exploded view of a section of the arm of FIG. 2 showing one embodiment of the thumb trigger assembly.

FIG. 3 shows a section of the right arm 23 and illustrates one construction of each of the thumb trigger assemblies of the arm. In the illustrated embodiment, the top surface of the arm 23 is formed with a plurality of spaced notches 44. A corresponding piezoelectric transducer 46 is sized to be installed in each of the notches as indicated by arrows 48 and may be secured therein with an appropriate adhesive, such as double sided tape. Piezoelectric transducers suitable for the present invention are available from a variety of sources including, for example, www.transducersdirect.com and others. The piezoelectric transducer 46 has a pair of wire leads 47 that carry signals produced by the transducer and these may be connected within the arm 23 to a multi-lead cable that ultimately is connected to cable 31 for delivering signals to the drum machine 14.

The piezoelectric transducer 46 preferably is covered by a pad 49 having a bottom surface 51 and a top surface 52. The bottom surface 51 contacts the piezoelectric transducer 46 in such a way that vibrations resulting from striking the top surface 52 of the pad are transmitted through the pad 49 and to the piezoelectric transducer 46 below. In this regard, a circular inset or recess may be formed in the bottom surface 51 of the pad 49 for receiving and cradling the piezoelectric transducer in order to maximize the transfer of vibrations to the transducer. The top surface 52 of the pad 49 may be formed with a curvature that matches the curvature of the top surface of the arm 23 if desired. Alternatively, the top surface 52 of the pad may be configured to project upwardly from the top surface of the arm in order that a percussionist may detect the positions of the pads better by touch. The pad 49 may be made of any material appropriate for transferring the vibrations of a strike to a transducer below such as, for instance, rubber, a polymer, cork, foam, jell, a combination of these, or some other appropriate material.

Figure 4:
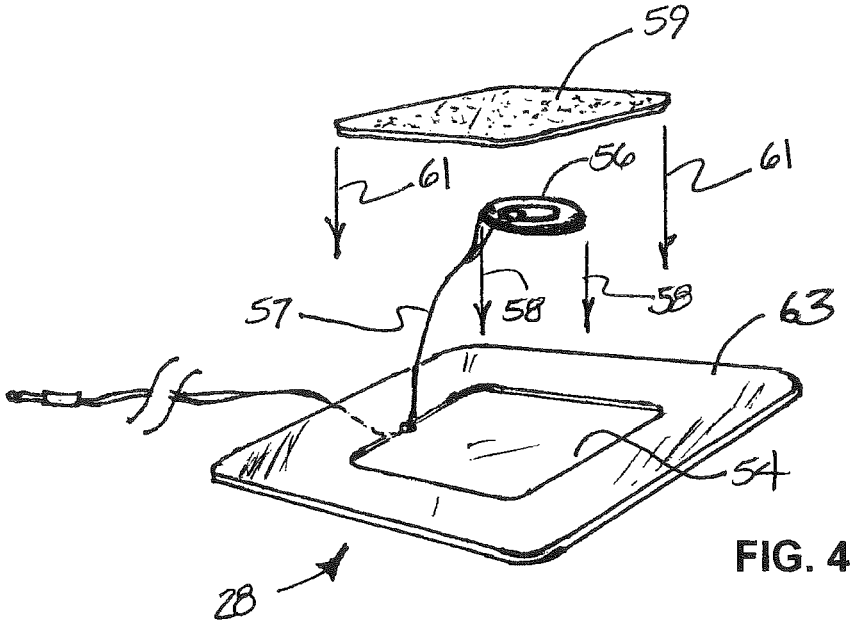
FIG. 4 is an exploded perspective view of one of the heel triggers showing one embodiment of the heel trigger assembly.
Figure 5:
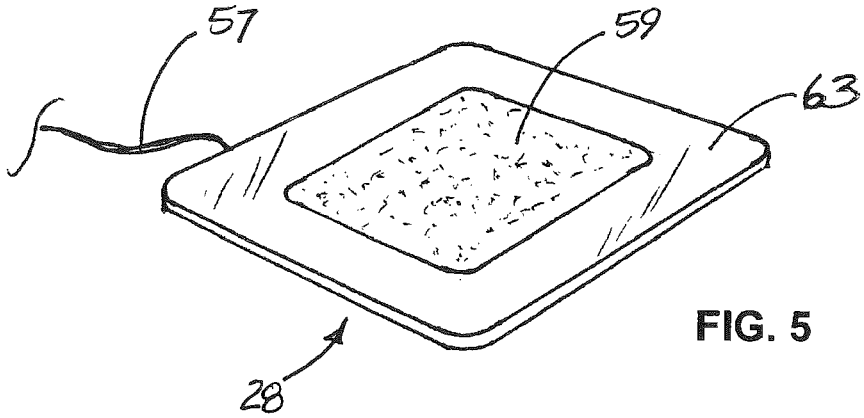
FIG. 5 is a perspective view of one embodiment of a heel trigger in its assembled state.

FIGS. 4 and 5 illustrate one possible construction of a heel trigger 28. The heel trigger 28 has a frame member 63, which is flat in the illustrated embodiment. The frame member is formed with a central recess or indentation 54 that is shaped to receive a heel pad 59. A piezoelectric transducer 56 is disposed at a preselected location within the recess 54 so that it is covered by the heel pad 59 when both are installed as indicated by arrows 58 and 61. Wire leads 57 carry signals produced by the piezoelectric transducer 56 and these signals ultimately are delivered to the drum machine 14. The heel pad 59 also is made of a material that transmits to the piezoelectric transducer vibrations caused by striking the pad 59 with ones heel, which produces a corresponding signal. This signal, when received at the drum machine 14, causes the drum machine to play a percussion sound previously assigned to the heel trigger.

In FIG. 5, the heel trigger 28 is shown in its assembled state. The heel trigger preferably is relatively flat so that it fits substantially flush to the floor. Alternatively, it may be wedge-shaped or otherwise shaped to enhance the comfort of a percussionist during play. A percussionist can thus "play" the heel trigger as if she were simply striking the floor with her heel while pivoting her foot on its ball. This has been found to be a natural, more accurate, and less fatiguing method of playing than the traditional technique of raising the entire foot and leg to operate a standard kick drum pedal during play.

Figure 6:
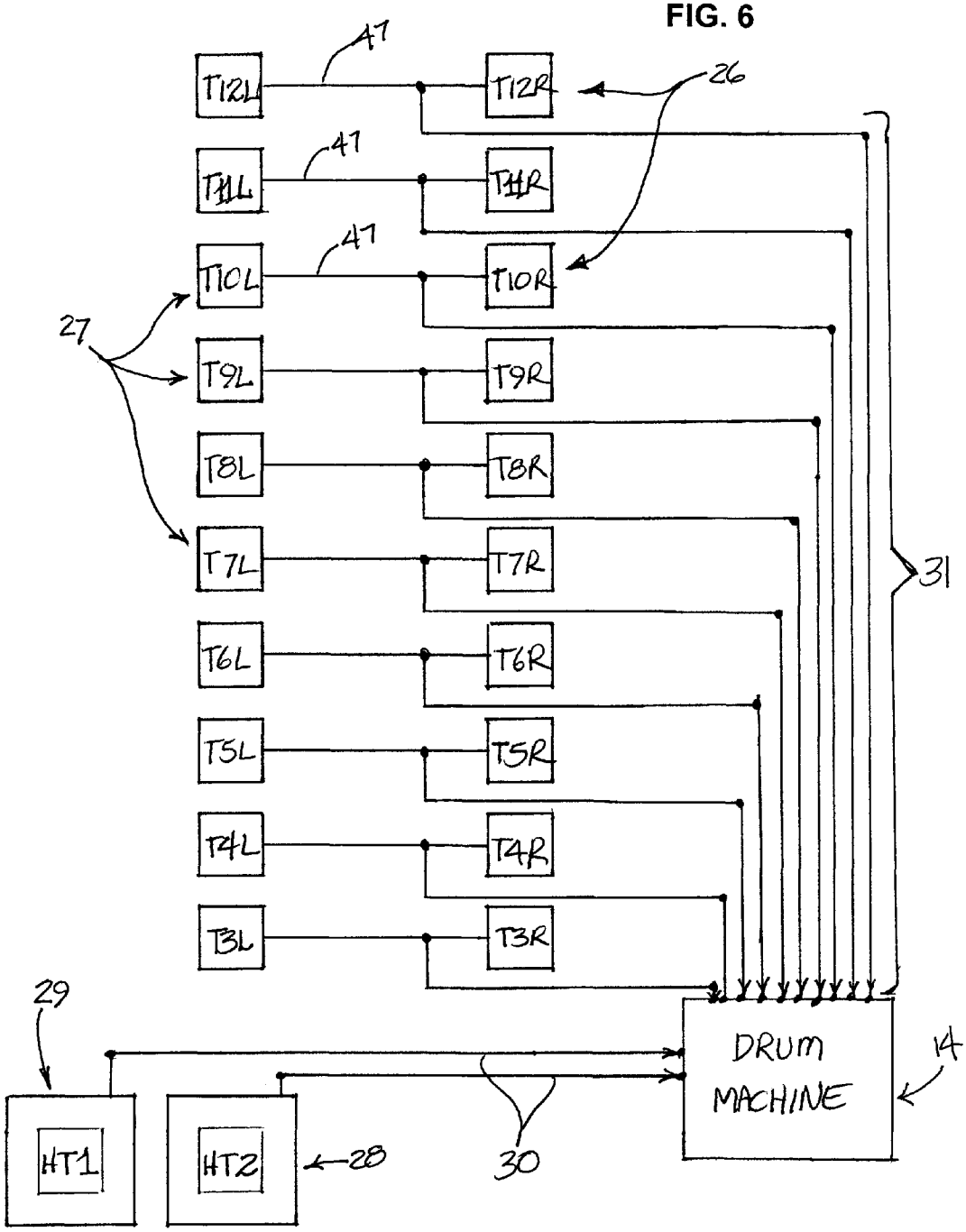
FIG. 6 is a schematic showing one possible way to interconnect the various triggers together and to the electronic drum machine.

FIG. 6 shows an example of how the various triggers may be connected together and to the drum machine for producing percussion sounds. More specifically, in this example, the wire leads of each thumb trigger 26 of the right arm of the chair (T3R-T12R) is electrically connected to the wire leads of the corresponding thumb trigger 27 of the left arm of the chair (T3L-T12L). In turn, each connected pair of thumb triggers is connected to an input of the electronic drum machine 14 through cable 31. In this way, the same percussion sound will be played by the drum machine 14 when either the left or the right thumb trigger of a pair is struck by a percussionist. The heel triggers 28 and 28 preferably are connected to independent inputs of the drum machine 14 so that each plays its own unique percussion sound when struck. For instance, striking the right heel trigger 28 with one's heel may result in a kick drum sound being played and striking the left heel trigger 29 may result in a hi-hat cymbal sound being played by the drum machine.

A vary wide variety of drum sound combinations may be assigned to the various triggers of the electronic percussion instrument according to the style of music being played, the song being played, or merely the whims of the percussionist. One example that is believed to provide context is shown in FIG. 7. Here, percussion sound assignments are made to mimic the sounds of a traditional acoustic drum kit when the instrument of this invention is played. More specifically, a kick drum sound is assigned to heel trigger 1 and a hi-hat cymbal sound is assigned to heel trigger 2. A snare drum sound is assigned to thumb triggers T3 (both left and right) and struck closed hi-hat cymbal and struck open hi-hat cymbal sounds are assigned to thumb triggers T4 and T5 respectively. A hi tom-tom sound is assigned to thumb triggers T6 while low tom-tom and floor tom-tom sounds are assigned to thumb triggers T7 and T8 respectively. Crash cymbal, ride cymbal rim, and ride cymbal hub sounds are assigned to thumb triggers T9, T10, and T11 respectively. Finally, in this example, thumb trigger T12 is reserved for a percussion sound of the percussionist's choice and may be, for example, a wood block sound, a rim shot sound, a stick click sound, or any other sound needed or desired by the percussionist.

It has been found that the forgoing relationship between percussion sounds and the thumb and heel triggers to which they are assigned provides a natural and intuitive playing experience. Further, the sounds that are used the most such as the snare drum sound and the struck hi-hat cymbal sounds are grouped nearer the percussionist's body, where they require less physical exertion to strike. Thus, a percussionist can play the electronic percussion instrument with ease and can duplicate with far less fatigue the complex drum rhythm patterns that can be played on a traditional acoustic drum kit. Furthermore, some drum rhythm patterns that are not possible with a traditional acoustic drum kit may be possible with the instrument of this invention.

Drum machines suitable for use with the present invention are well known and need not be described in detail here. One example is the iconic Alesis® D4 drum machine, which has 12 on-board trigger inputs. There also are is a variety of "trigger-to-midi" interfaces available that convert trigger signals such as those described above to midi signals that, in turn, can drive midi drum machines such as the Alesis® DR16 or DR18 or any other midi synthesizer device. These are just a few examples, and other arrangements and devices might be substituted to obtain substantially the same result.

The invention has been described herein in terms of preferred embodiments and methodologies considered by the inventor to represent the best mode of carrying out the invention. However, the embodiments and examples described above are not intended to be and should not be construed to be requirements or limitations of the scope of the invention that they embody. For example, it is considered preferable that the heel triggers be played with the heel of a percussionist's foot. They may, however, be played with the ball of the foot, the entire foot, or in any other desired way, all within the scope of the invention. Likewise, it is not a limitation that the thumb triggers be struck with the thumbs of a percussionist. Other fingers, wrists, forearms, and even sticks may be used if desired to strike the thumb triggers for producing percussion sounds. In fact, unique styles and unique drum rhythms not always possible with acoustic drum kits may be developed using combinations of different striking techniques. The arms of the chair of this instrument need not have a flat surface as shown in the exemplary embodiments. Indeed, the arms may be round or oval in cross section with the trigger pads extending partially or completely around their respective arms. Striking a trigger pad at any location around an arm in such an embodiment would then result in a corresponding sound being played.

Also, while the preferred use of the instrument is as a percussion instrument, it also is within the scope of the invention that the instrument be used to play other sounds as well. For instance, the thumb triggers and/or heel triggers may be assigned to string sounds, woodwind sounds, ethereal sounds, or any other sounds that can be played by an electronic synthesizer. Thus, the instrument of this invention may be used to play an orchestral arrangement, a rock guitar solo, or an eclectic sound arrangement. A Foley artist may find the instrument of this invention useful for playing sound effects to be incorporated into a radio or television show. Accordingly, the invention is not necessarily limited to playing only percussion sounds.

The above and other additions, deletions, and modifications, both subtle and gross, might be made to the exemplary embodiments described above without departing from the spirit and scope of the invention as set forth in the claims.

What is claimed is:

1. An electronic percussion instrument comprising:

a chair having at least one arm;

a set of triggers arrayed along at least a majority portion of the at least one arm and being configured to be struck by a percussionist while playing the percussion instrument;

an electronic drum machine; and a connection between the set of triggers and the electronic drum machine such that striking one of the triggers causes a corresponding percussion sound to be played by the electronic drum machine.

2. An electronic percussion instrument as claimed in claim 1 further comprising an audio amplifier and a loudspeaker driven by the audio amplifier, the electronic drum machine being connected to the audio amplifier for playing percussion sounds through the loudspeaker.

3. An electronic percussion instrument as claimed in claim 1 further comprising at least one heel trigger configured to be struck with a foot of a percussionist while playing the percussion instrument and a connection between the heel trigger and the drum machine for playing a sound in response to the heel trigger being struck.

4. An electronic percussion instrument as claimed in claim 3 wherein the at least one heel trigger comprises two heel triggers.

5. An electronic percussion instrument as claimed in claim 1 wherein the at least one arm has a top surface and is curved, the triggers being arranged along the top surface of the curved arm.

6. An electronic percussion instrument as claimed in claim 5 wherein the arm has sides and wherein the top surface is oriented substantially perpendicular to the sides.

7. An electronic percussion instrument as claimed in claim 1 wherein the chair comprises two arms.

8. An electronic percussion instrument as claimed in claim 7 wherein the chair comprises a seat and wherein the two arms are disposed on either side of the seat.

9. An electronic percussion instrument as claimed in claim 8 wherein the chair comprises a back.

10. An electronic percussion instrument as claimed in claim 8 wherein the set of triggers comprises a set of triggers arrayed along at least a majority portion of each of the two arms.

11. A method of playing electronic percussion sounds comprising the steps of:

(a) obtaining an electronic percussion instrument as claimed in claim 8;

(b) sitting on the seat; and (c) striking the triggers sequentially with the hands to cause corresponding percussion sounds to be played by the electronic drum machine.

12. The method of claim 11 wherein step (c) comprises striking the triggers sequentially with at least the thumbs.

13. The method of 11 further comprising obtaining at least one trigger on the floor in front of the chair and striking trigger on the floor with a foot to cause corresponding percussion sounds to be played by the electronic drum machine.

14. The method of claim 13 wherein the at least one trigger comprises two triggers.

15. A controller for playing electronically generated sounds, the controller comprising:

a chair having a seat, a first arm disposed on one side of the seat and having a top surface, and a second arm disposed on an opposite side of the seat and having a top surface;

a plurality of triggers arrayed along the top surfaces of the first and second arms, the triggers producing electronic signals when struck; and a connection for connecting electronic signals produced by the triggers to an electronic sound synthesizer such that striking one of the triggers causes the electronic synthesizer to produce a sound corresponding to the trigger that is struck;

each of at least some of the triggers arrayed along the top surface of the first arm being operatively paired with a corresponding trigger arrayed along the top surface of the second arm such that the same sound is produced by the electronic synthesizer when either trigger of a pair of triggers is struck.

16. A controller as claimed in claim 15 wherein the first and second arms are curved upwardly.

17. A controller as claimed in claim 15 further comprising at least one trigger configured to be placed on a surface in front of the chair.

18. A controller as claimed in claim 15 wherein each trigger comprises a piezoelectric transducer.

19. A controller as claimed in claim 18 wherein each piezoelectric transducer is covered with a pad.

20. A controller as claimed in claim 19 wherein the pad is made of a material that transmits vibrations from a strike to the piezoelectric transducer.

21. A chair comprising a seat, a back, a first arm having a length and being disposed on one side of the seat, and a second arm having a length and being disposed on the other side of the seat, the first and second arms being curved upwardly and outwardly from the back with the first arm bearing an array of spaced piezoelectric triggers along at least a majority of its length and the second arm bearing an array of spaced piezoelectric triggers along at least a majority of its length, the triggers being located to be struck with at least the thumbs of a percussionist sitting in the chair.

22. An electronic instrument comprising:

a chair having a seat, a first arm located on one side of the seat, and a second arm located on an opposite side of the seat;

a first plurality of triggers arrayed along the first arm and a second plurality of triggers arrayed along the second arm, the triggers producing a signal when struck;

a synthesizer;

a connection between the first and second pluralities of triggers and the synthesizer for delivering signals produced by the triggers to the synthesizer;

the synthesizer being programmed to play a sound corresponding to each trigger when the trigger is struck; and each of at least some of the first plurality of triggers being operatively paired with a corresponding trigger of the second plurality of triggers such that the same sound is played by the synthesizer when either trigger of a pair of triggers is struck.

23. An electronic instrument as claimed in claim 22 wherein the synthesizer comprises a drum machine and wherein the sounds played by the synthesizer comprise percussion sounds.

24. An electronic instrument as claimed in claim 22 further comprising at least one trigger for placement on a floor in front of the chair for being struck by a foot, the trigger for placement on the floor producing a signal when struck that is delivered to the synthesizer which plays a sound in response.

* * * * *